United States Patent [19]

Murase

[11] Patent Number: 4,550,509

[45] Date of Patent: Nov. 5, 1985

[54] AIR GUIDE ARRANGEMENT FOR A DRUM-TYPE DRIER

[75] Inventor: Koji Murase, Ichinomiya, Japan

[73] Assignee: Tokyo Shibaura Denki Kabushiki Kaisha, Kawasaki, Japan

[21] Appl. No.: 492,828

[22] Filed: May 9, 1983

[30] Foreign Application Priority Data

Jun. 16, 1982 [JP] Japan ..... 57-104120

[51] Int. Cl.[4] ..... D06F 58/00; F26B 11/02

[52] U.S. Cl. ..... 34/133; 34/54

[58] Field of Search ..... 34/130, 131, 132, 133, 34/53, 54

[56] References Cited

U.S. PATENT DOCUMENTS

| | | | |
|---|---|---|---|
| 2,812,593 | 11/1957 | Olthuis | 34/133 |
| 2,878,579 | 3/1959 | Fuchs | 34/133 |
| 3,471,940 | 10/1969 | Smith | 34/133 |
| 3,729,834 | 5/1973 | Fox | 34/133 |
| 4,033,047 | 7/1977 | Kawai | 34/133 |
| 4,123,851 | 11/1978 | Itoh et al. | 34/133 |

FOREIGN PATENT DOCUMENTS

| | | |
|---|---|---|
| 2095384A | 9/1982 | United Kingdom . |
| 2095384B | 9/1982 | United Kingdom . |

*Primary Examiner*—Albert J. Makay
*Assistant Examiner*—Steven E. Warner
*Attorney, Agent, or Firm*—Cushman, Darby and Cushman

[57] ABSTRACT

A drum type drier has a drum housed in a housing. The drum has a cylindrical body and first and second end plates respectively closing both ends of the cylindrical body. The first end plate is provided with an inlet-outlet port to take clothings into and out of the drum. An air inlet and air outlet which communicate with the interior of the drum are arranged to face each other with the inlet-outlet port between. An air stream heated by a heater is conducted into the drum through the air inlet to take moisture from the clothings housed in the drum. The air stream which has taken moisture from the clothings is discharged to the outside of the drum through the air outlet.

8 Claims, 5 Drawing Figures

AIR GUIDE ARRANGEMENT FOR A DRUM-TYPE DRIER

BACKGROUND OF THE INVENTION

This invention relates to a drier, and more particularly to a drum type drier.

A drum type drier generally comprises a housing and a drum rotatably set in the housing. Clothings placed in the drum are dried by hot air drawn into the drum. The conventional drum type drier has a hot air inlet provided substantially in the center of the backside of the drum, and the exhaust outlet formed in the front part of the drum. In such an arrangement, the hot air inlet and exhaust outlet are set along the rotation axis of the drum in a mutually facing state, so that a hot air stream fed into the drum at the inlet tends to be directly drawn off at the outlet. The hot air stream is retained in the drum for a relatively short length of time, failing to ensure sufficient contact between the hot air stream and the articles of clothing being dried. The hot air stream is not fully utilized, decreasing the drying efficiency. There has come into demand a combination unit including a drier located above a washing apparatus and it has been attempted to reduce the overall thickness of the drier by narrowing the axial length of the drum in order to meet this requirement. However, this attempt is accompanied with the drawbacks that the hot air inlet and exhaust outlet are drawn nearer each other, and the hot air stream tends to flow more directly through the drum from the inlet to the outlet.

The U.S. Pat. No. 2,940,179 discloses a drum type drier in which the backside of a drum is provided with the inlet and outlet for a hot air stream. The outlet is set at the center of the backside of the drum, and the outlet is radially spaced from the outlet.With the drum type drier of said United States patent, the hot air inlet and exhaust outlet are not arranged in a mutually facing position, thereby assuring a longer retention of the hot air stream in the drum than in the aforementioned drum type drier. With said patented drier, however, the hot air inlet and exhaust outlet are set adjacent to each other on the backside of the drum, unavoidably shortening the passage of the hot air stream and failing to ensure a sufficient retention time of the hot air stream.

SUMMARY OF THE INVENTION

This invention has been accomplished in view of the above-mentioned circumstances and is intended to provide drum type drier having a high drying efficiency in which a hot air stream is retained in the drum for a long time, thereby assuring full contact between the hot air stream and the clothings.

To attain the above-mentioned object, this invention provides a drum type drier which comprises: a housing; a drum which is rotatably set in the housing to receive clothings, and has a hollow cylindrical body and first and second end plates covering both ends of the hollow cylindrical body, the first end plate being provided with an inlet-outlet port through which clothings are taken into and out of the drum; first guide means which is provided with a hot air inlet communicating with the interior of the drum to guide hot air thereinto; second guide means which is provided with an exhaust outlet communicating with the interior of the drum to conduct air held in the drum to the outside of the drum, the hot air inlet and exhaust outlet occupying a mutually facing position with the inlet-outlet port interposed therebetween; heating means for heating an air stream passing through the first guide means; driving means for rotating the drum; and air-ventilating means for conducting the air stream heated by the heating means into the drum through the first guiding means for removing moisture from the clothings and carrying moisture-bearing air to the outside of the drum through the second guide means.

With a drum type drier embodying this invention, the hot air inlet and exhaust outlet face each other with the inlet-outlet port for objects for drying interposed therebetween. Consequently, hot air stream feed into the drum run counter to moisture-bearing air stream drawn out of the drum. The hot air inlet and exhaust outlet are sufficiently spaced apart from each other. The hot air stream brought into the drum flows diametrically in the drum to the outlet, thereby prolonging the retention time of hot air stream in the drum and assuring sufficient contact between the hot air stream and the clothings. Therefore, a drum type drier embodying this invention has a high drying efficiency.

BRIEF DESCRIPTION OF THE DRAWINGS

FIGS. 1 to 3 jointly illustrate a drum type drier according to a first embodiment of this invention; in which FIG. 1 is a front view of the same, FIG. 2 is a sectional view on line II—II of FIG. 1, and FIG. 3 is a sectional view on line III—III of FIG. 1; and FIGS. 4 and 5 jointly indicate a drum type drier according to a second embodiment of the invention; in which FIG. 4 is a front view of the same, and FIG. 5 is a sectional view of the same enlarged in part.

DETAILED DESCRIPTION OF THE PREFERRED EMBODIMENTS

Figure 1:
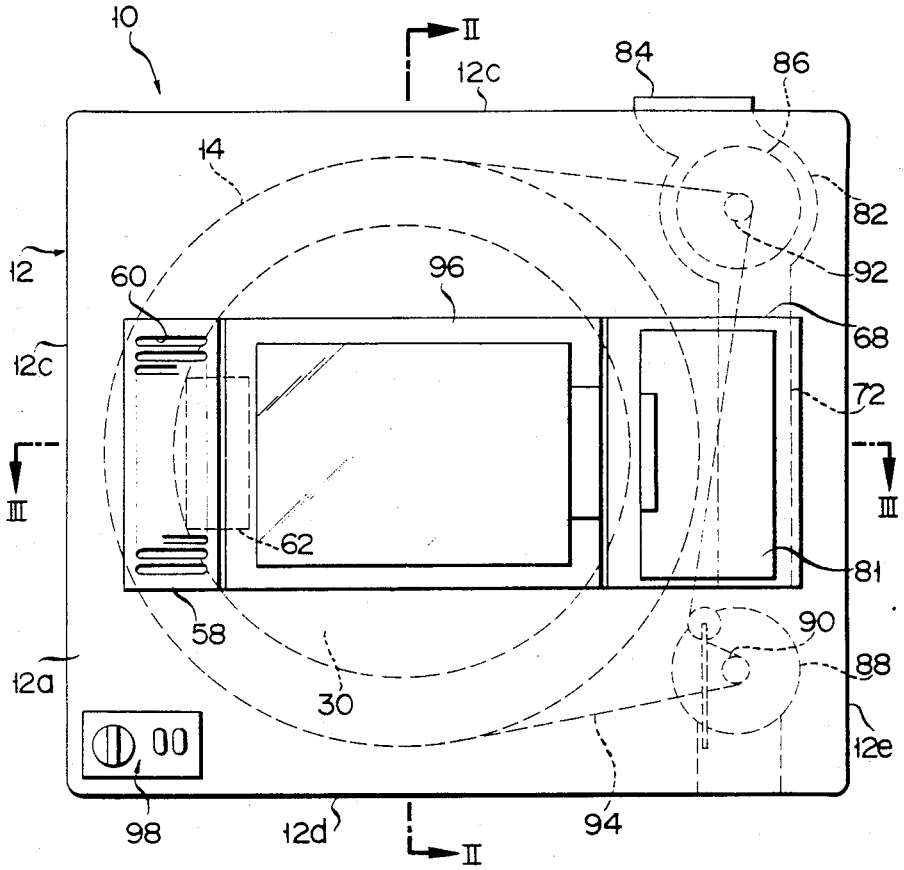

Description will now be given with reference to the accompanying drawings of a drum type drier according to a first embodiment of this invention. A drum type drier 10 comprises a parallelepiped housing 12 and a drum 14 rotatably set therein. The housing 12 has a rectangular front board 12*a*, rectangular rear board 12*b*, rectangular upper board 12*c*, rectangular bottom board 12*d* and rectangular lateral boards 12*e*. A horizontally extending rectangular opening 16 is formed substantially in the center of the front board 12*a*.

The drum 14 has a hollow flattened cylindrical body 18, a front end plate 20 closing the front side of the body 18 and a rear end plate 22 closing the rear side of the body 18. This drum 14 is a flattened type whose axial measurement is smaller than its diametrical measurement. A circular opening 24 is formed in the front end plate 20 concentrically with the drum body 18.A pivotal shaft 26 projects from the center of the rear end plate 22 toward the rear board 12*b* of the housing 12. This pivotal shaft is rotatably supported on a support frame 28 fixed to the rear board 12*b*. A plurality of, for example, three stirring blades 29 are fitted to the inner peripheral wall of the drum body 18. These stirring blades 29 are equidistantly arranged in the circumferential direction and extend axially of the drum body 18.

The drum type drier 10 has an annular air duct 30 fitted to the inner surface of the front board 12*a* to surround the opening 16. The air duct 30 has a rectangular inner wall 32 extending along the peripheral edge of the opening 16, a circular outer peripheral wall 34 having a slightly smaller diameter than that of the opening 24 of the drum 14 and an annular wall 36 which connects the inner and outer walls together and spatially faces the front board 12*a*. The outer peripheral wall 34 is provided with a flange 38 fixed to the inner wall of the front board 12*a*. The annular air duct 30 is fitted into the opening 24 of the drum 14. The outer peripheral wall 34 is engaged with the peripheral edge of the opening 24 with a packing 40 interposed therebetween. The outer peripheral wall 34 is provided with a bearing (not shown), causing the drum 14 to be rotatably supported in the housing 12. The air duct 30 is positioned inside of the opening 24 to constitute part of the front end plate 20 of the drum 14. The inner wall 32 of the air duct 30 defines an inlet-outlet port 42 through which washed pieces of clothing are taken into or out of the drum.

The air duct 30 and front board 12*a* jointly define an annular air discharge passage 44. As seen from FIG. 3, the front board 12*a* is provided with ports 46, 48 communicating with the discharge passage 44. Those ports 46, 48 are respectively formed in the right and left side of the aforesaid inlet-outlet port 42. The annular wall 36 of the air duct 30 is provided with a large number of penetrating holes 50, 52 communicating with the interior of the drum 14. The penetrating holes 50 are made to face the port 46 of the front board 12*a*, jointly constituting an air inlet 54 claimed in this invention. The penetrating holes 52 are made to face the port 48 of the front board 12*a*, jointly constituting an air outlet 56 claimed in the invention. Particularly, in this embodiment, the air inlet 54 is formed on that side of the drier on which clothings drying stirred by the rotation of the drum 14 are finally allowed to fall (namely, on the left side of the inlet-outlet port 42 for the clothings, because the drum 14 is rotated counterclockwise as later described). Namely, the inlet-outlet port 42 is positioned between the inlet 54 and outlet 56 of the air stream.

Figure 3:
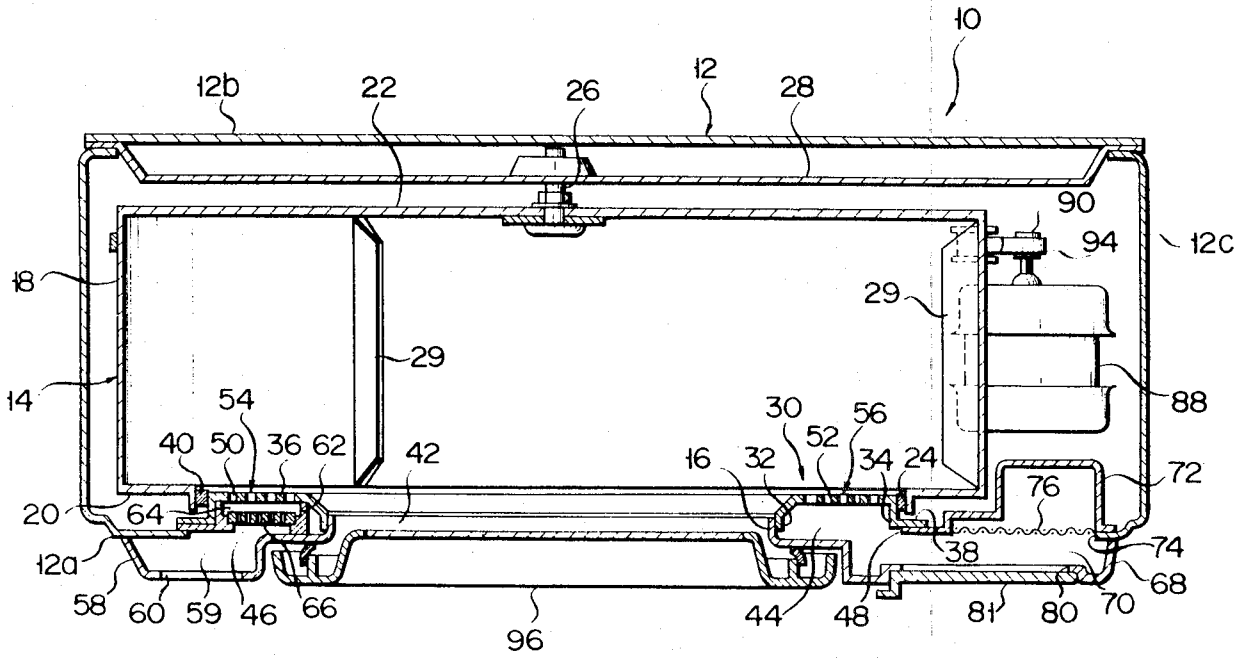

As shown in FIGS. 1 and 3, a substantially rectangular air grill 58 is fitted to the front board 12*a* of the housing 12 on the left side of the inlet-outlet port 42 to close the port 46 of the front board 12*a*, thereby constituting an air inlet chamber communicating with the port 46. The front side of the air grill 58 is provided with a large number of air-introducing slits 60. A cylindrical air-guiding case 62 having a rectangular cross section is held in the air duct 30. This air-guiding case 62 is fitted at one end to the annular wall 36 of the air duct 30 to surround the air stream inlet 54, and at the other end to the inner wall of the front board 12*a* to surround the port 46. The air inlet 54 and the port 46 are made to communicate with each other by the air-guiding case 62 in an airtightly state separated from the air discharge passage 44. The air-guiding case 62 defines an air-introducing passage 64. A heater 66 (FIG. 3) is received in the air-guiding case 62 in a state facing the air inlet 54. The heater 66 is, for example, a semiconductor having a positive temperature coefficient, and heats the air stream flowing through the air-introducing passage 64. The air-guiding case 62, air inlet 54 and air grill 58 jointly constitute first air-guiding means.

A cover 68 is fitted to the front board 12*a* on the right side of the inlet-outlet port 42 for the clothings to close the port 48 of the front board 12*a*. The cover 68 defines an exhaust chamber 70 communicating with the air outlet 44 through the port 48. The inner wall of the front board 12*a* is fitted with an exhaust duct 72 extending vertically. The lower end of the exhaust duct 72 communicates with the exhaust chamber 70 through a port 74 formed in the front board 12*a*. This port 74 is fitted with a lint filter 76. The air outlet 56, air duct 30, cover 68 and exhaust duct 72 jointly constitute second air-guiding means claimed in this invention. A port 80 for checking the lint filter 76 is provided in front of the cover 68 in a state normally closed by a door 81. The upper end of the exhaust duct 72 communicates with a fan casing 82 set in the upper region of the housing 12. The fan casing 82 has an air discharge port 84 formed in the upper board 12*c* of the housing 12 to communicate with the atmosphere. A fan 86 is rotatably set in the fan casing 82. The fan casing 82 and fan 86 jointly constitute air-ventilating means claimed in this invention.

A motor 88 as driving means is fixed to a bottom board 12*d* inside the housing 12. As seen from FIG. 1, a belt 94 is stretched over a drive pulley 90 engaged with the rotary shaft of the motor 88, driven pulley 92 fitted to the rotation shaft of the fan 86 and the peripheral wall of the drum 14. When the motor 88 is driven, the drum 14 and fan 86 are rotated counterclockwise alike. Referring to FIG. 1, reference numeral 96 denotes a door for closing and opening the inlet-outlet port 42 for the clothings, and reference numeral 98 represents a timer fitted to the front board 12*a*.

Description will now be given with the accompanying drawings of the operation of the drum type drier 10 embodying this invention which is constructed as described above. First, washed pieces of clothing are put into the drum 14 through the inlet-outlet port 42. After the door 96 is closed, and the timer 98 is set, power is supplied to the motor 88 and heater 66. Then the fan 86 is quickly driven, and the drum 14 is rotated counterclockwise. The counterclockwise rotation of the drum 14 causes the pieces of clothing held therein to be caught by the stirring blades 29 and pushed upward in contact with the inner peripheral wall of the drum 14. When brought to a point close to the uppermost section of the drum 14, the pieces of clothing fall to the left side of the drum 14 due to its counterclockwise rotation while getting loose. The above mentioned stirring of the washed pieces of clothing is repeated by the rotation of the drum 14.

On the other hand, external air is sucked into the drum 14 through the air-introducing slits 60 by the rotation of the fan 86 and flows through the air grill 58 and air-guiding case 62 in turn to the air inlet 54. In the meantime, the external air is heated by the heater 66 to be changed into hot air stream. The hot air stream are introduced from the air inlet 54 to the left region of the interior of the drum 14 and also toward the rear board 22 of the drum 14. The hot air stream feed into the drum 14 strike against the washed pieces of clothing continuously falling to the left region of the interior of the drum 14 while getting loose, and flow between the loosened pieces of clothing while being scattered over a broad area, thereby removing the moisture of the washed clothing. The hot air stream as a whole turn to the right region of the interior of the drum 14 to contact the washed pieces of clothing rising upward due to the counterclockwise rotation of the drum 14, thereby removing moisture therefrom.

The hot air stream which has taken moisture from the washed clothings passes through the air outlet 56 and air discharge passage 44 into the exhaust chamber 70, then into the fan casing 82 through the lint filter 76 and exhaust duct 72 and is finally drawn off to the outside of the housing 12 through the discharge port 84.

With the foregoing embodiment, the air inlet 54 and air outlet 56 face each other at a sufficiently great distance with the inlet-outlet port 42 interposed therebetween. Therefore, hot air stream ejected into the drum 14 through the inlet 54 do not run straight forward toward the outlet 56, but are diverted in the drum 14 to flow diametrically thereto. Therefore, the hot air stream is spread over a broad area in the drum 14, though it is made thin, and retained in the drum 14 for a relatively long time. As a result, the hot air stream contacts the washed pieces of clothing more often, thereby increasing the drying efficiency. Furthermore, the air inlet 54 is positioned on that side of the drum 14 on which the washed pieces of clothing fall. Therefore, the hot air stream having relatively high temperature and low humidity flows between the loosened washed pieces of clothing, thereby assuring efficient drying. On the side of the air outlet 56, the washed pieces of clothing are conveyed upward in a state that they rest against the inner peripheral wall of the drum 14. Consequently, the air outlet 56 is prevented from being closed, and the hot air stream which has taken moisture from the washed pieces of clothing is smoothly drawn into the exhaust chamber 70 through the air outlet 56. As described above, the drum type drier 10 embodying this invention has the advantage of always ejecting fresh hot air stream on the loosened washed pieces of clothing, and enabling moistened hot air stream to be quickly discharged, thereby elevating the drying efficiency.

With the conventional drum type drier in which a hot air stream is introduced into the drum at its rear end portion and drawn off at its front end portion, a circular air diffuser is provided behind the drum. This air diffuser and the interior of the drum communicate with each other through a large number of inlets formed in the rear board of the drum. The air stream is brought into the drum through the air diffuser. The peripheral edge of the air diffuser has to be fitted with sealing material to airtightly close a space defined between the air diffuser and drum. The inlet-outlet port for clothings formed in the front board of the drum is held by a support cylinder formed in the housing. A space between the peripheral edge of the inlet-outlet port and the support cylinder also has to be sealed. In other words, the conventional drum type drier has to be sealed in both front and rear. Consequently, the conventional drum type drier has the drawbacks that the arrangement is complicated, the drum undergoes heavy rotation resistance, and the motor must have a large capacity. In contrast, a drum type drier embodying this invention has the advantages that the air inlet 54 and air outlet 56 are formed in the air duct 30 fitted into the opening 24 of the drum 14. Consequently, it is necessary to seal only a space defined between the air duct 30 and the peripheral edge of the opening 24, thereby assuring the simplification of the arrangement of the drum type drier and a reduction in the rotation resistance of the drum 14.

Figure 5:
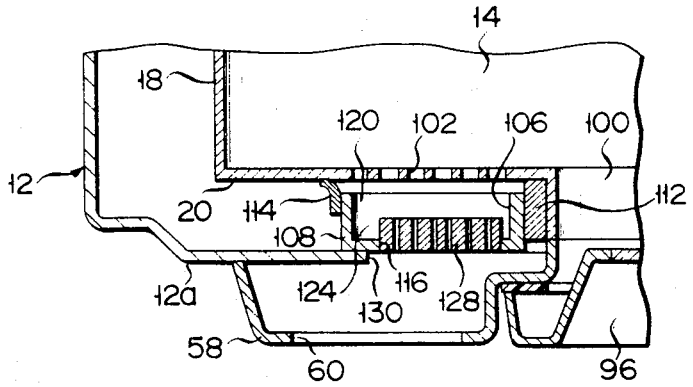
Figure 2:
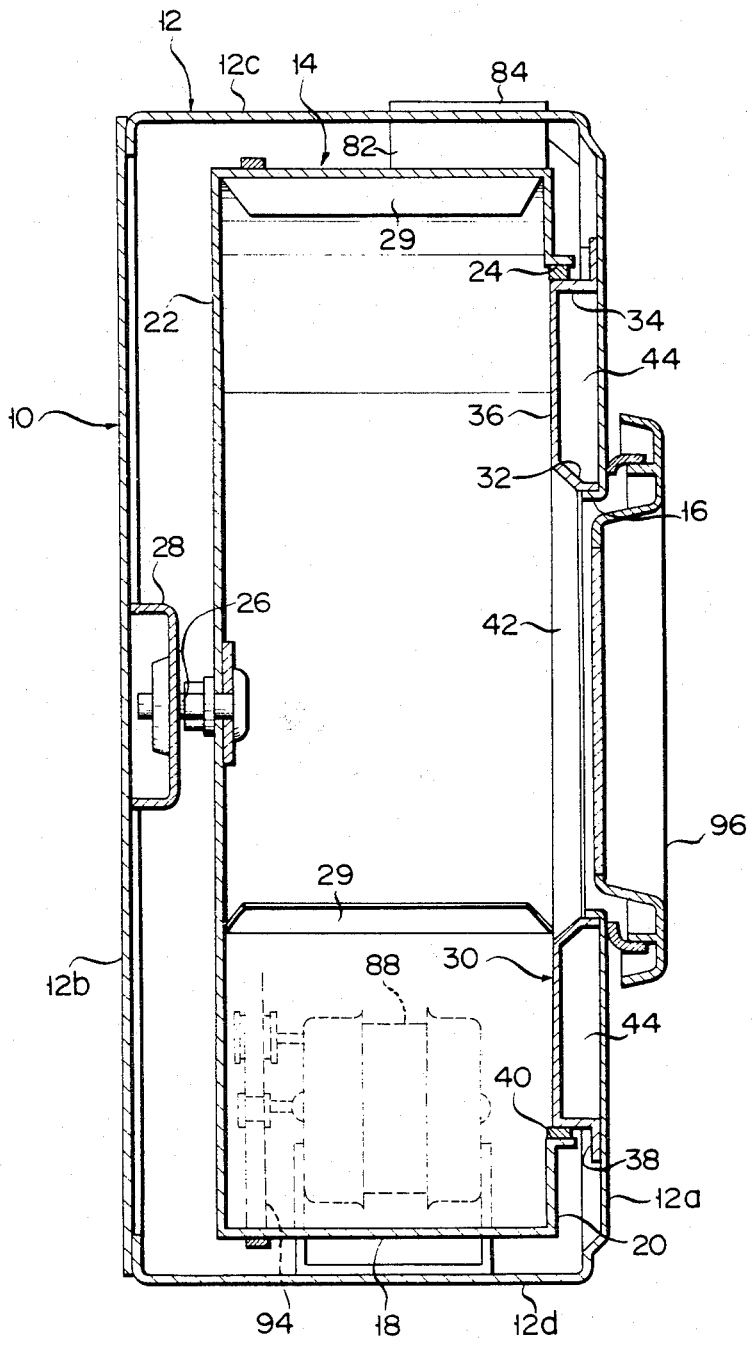
Figure 4:
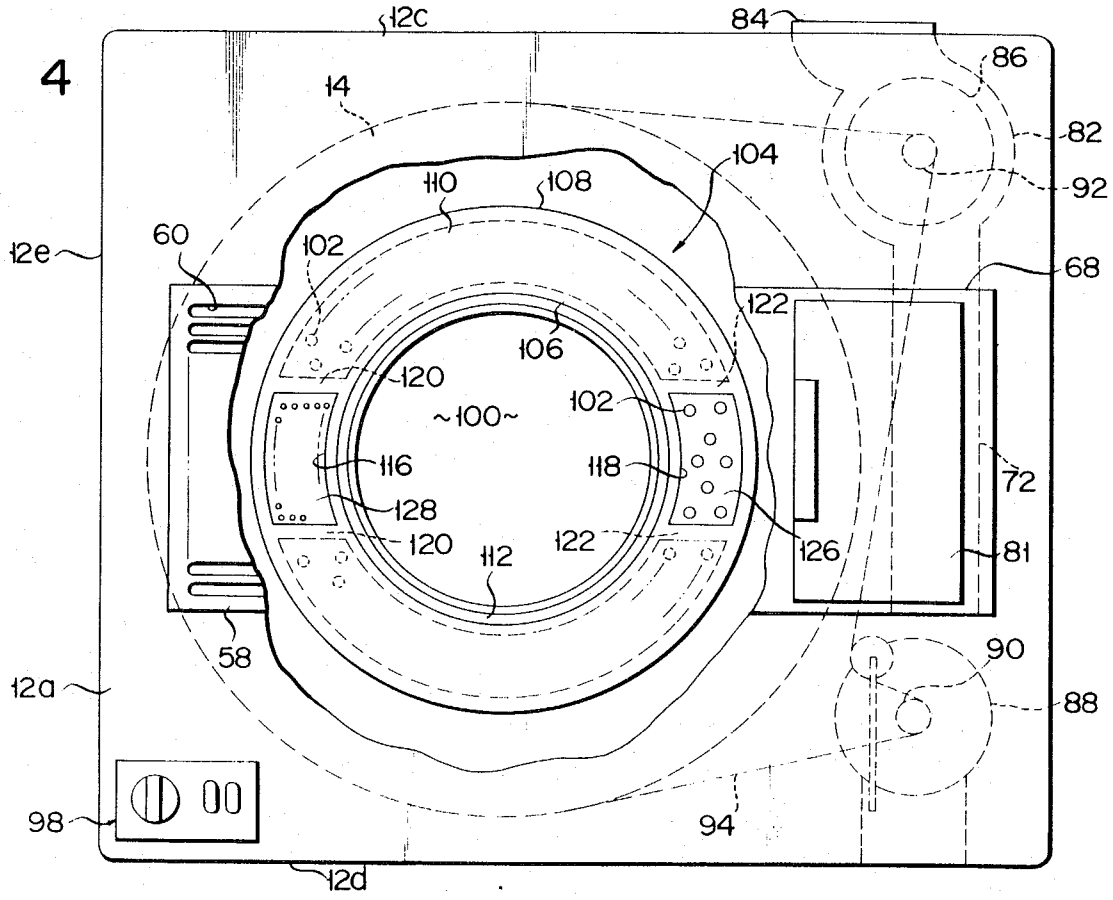

It will be noted that the foregoing embodiment is simply for illustration of this invention, and consequently does not restrict the application of the invention. Namely, it is possible to construct a drum type drier as shown in FIGS. 4 and 5 (a second embodiment). With this second embodiment, a circular opening 100 is formed in the front board 20 of the drum 14 concentrically with the drum body 18 and serves as an inlet-outlet port through which washed clothings are taken into and out of the drum. A large number of penetrating holes 102 are formed in the front end plate 20 of the drum 14 around the circular opening 100. An annular air guide 104 is fitted to the inner wall of the front board 12*a* of the housing 12. The air guide 104 includes an inner peripheral wall 106 and outer peripheral wall 108 both concentric with the circular opening 100 and an annular wall 110 which connects the inner and outer peripheral walls 106, 108 and faces the front board 20 of the drum 14. A sealing material 112 is fitted between the inner peripheral wall 106 and the peripheral edge of the circular opening 100. Another sealing material 114 is fitted between the outer peripheral wall 108 and the front end plate 20 of the drum 14. Therefore, the numerous penetrating holes 102 are airtightly closed by the sealing materials 112, 114 and the air guide 104. The air guide 104 has first and second ports 116, 118 formed in the annular wall 110. These first and second ports 116, 118 are provided on both right and left sides of the circular opening 100 in a mutually facing state. The air guide 104 has a pair of partition walls 120 set above and below the first port 116 and a pair of partition walls 122 positioned above and below the second port 118. The inner peripheral wall 106, outer peripheral wall 108 and partition wall 120 jointly define an air-introducing passage 124 (FIG. 5) communicating with the first port 116. The inner peripheral wall 106 and outer peripheral wall 108 and partition wall 122 jointly define an air-discharging passage 126 (FIG. 4) communicating with the second port 118. The air-introducing passage 124 and air-discharging passage 126 communicate with the interior of the drum 14 through the numerous penetrating holes 102. Those of the penetrating holes 102 which are positioned in the air-introducing passage 124 jointly constitute an air inlet. Those of the penetrating holes 102 which are positioned in the air-discharging passage 126 jointly constitute an air outlet. The first port 116 is fitted with a heater 128 for heating the air stream flowing through the air-introducing passage 124. That portion of the front board 12*a* which faces the first port 116 is provided with an opening 130 (FIG. 5), which is covered with the air grill 58 fitted to the front board 12*a*. An external air stream introduced through the slits of the air grill 58 passes through the heater 128, air-introducing passage 124 and penetrating holes 102 into the drum 14. That portion of the front board 12*a* which faces the second port 118 is provided with an opening (not shown) which is closed with a cover 68 (FIG. 3). A hot air stream brought into the drum 14 is drawn off through the penetrating holes 102 and air-discharging passage 126.

With the second embodiment constructed as described above, too, the air inlet and air outlet spatially face each other across the inlet-outlet port of the washed pieces of clothing, that is, the circular opening 100 of the front board 20 of the drum 14. As in the preceding first embodiment, therefore, hot air stream brought into the drum 14 through the air-introducing passage 116 and penetrating holes 102 is not immediately drawn off, but runs diametrically through the drum 14, and is retained therein for a relatively long time, thereby assuring highly efficient drying.

With the foregoing two embodiments, the air inlet and air outlet were set on both right and left sides of the inlet-outlet port for the clothings. However, the air inlet and outlet may be respectively provided above and below the inlet-outlet port, provided they spatially face each other across the inlet-outlet port.

What is claimed is:

1. A drum type drier comprising:

a housing having a front board with an opening therein;

a drum, rotatably provided in the housing to receive clothing to be dried, said drum including a cylindrical body and first and second end plates closing both ends of the cylindrical body, the first end plate having a circular opening formed concentrically with the drum;

a frame-like air guide fixed to the front board around the front board opening, positioned in the circular opening of the first end plate for rotatably supporting the drum and defining an inlet-outlet port through which clothing is placed into or removed from the drum;

first guide means having an air inlet positioned in the air guide and communicating with the interior of the drum to guide air into the drum;

second guide means having an air outlet positioned in the air guide and communicating with the interior of the drum to guide air from the drum, said air inlet and air outlet being opposite to each other with respect to said inlet-outlet port with said inlet-outlet port arranged between them;

heating means for heating air passing through the first guide means;

driving means for rotating the drum; and air-ventilating means which conducts heated air from the heating means into the drum through the first guide means to remove moisture from the clothing and to conduct air from the drum through the second guide means, wherein said frame-like air guide includes a cylindrical outer wall fitted in the circular opening of the first end plate, and an inner wall arranged around the opening of the front board and defining the inlet-outlet port jointly with the circular opening and the front board opening, and an annular wall having an opening, connecting the cylindrical outer wall and inner wall and being substantially flush with the first end plate, and wherein said air inlet and air outlet are formed in the annular wall, and wherein said air guide and front plate jointly define an air-discharging passage communicating with the air outlet, and said first guide means including an air-blowing cylinder provided in the air guide, communicating with the air inlet, and defining an air-introducing passage separated from the air-discharging passage.

2. The drum type drier according to claim 1, wherein said first guide means includes a grill fixed to the front board and defining an air-introducing chamber communicating with the air-introducing passage and the outside of the housing.

3. The drum type drier according to claim 1, wherein said heating means includes a heater provided in the air-introducing passage.

4. The drum type drier according to claim 3, wherein said heater is of the semiconductor type having positive temperature coefficient.

5. The drum type drier according to claim 1, wherein said second guide means includes a cover which is fitted to the front plate to define an exhaust chamber communicating with the air-discharging passage, and an exhaust duct having first and second ends which duct is fitted to the housing and communicates at said first end with the exhaust chamber.

6. The drum type drier according to claim 5, wherein said air-ventilating means includes a fan casing which is received in the housing and communicates with said second end of the exhaust duct and a fan received in the fan casing, the fan casing being provided with an air-discharging port open to the outside of the housing.

7. The drum type drier according to claim 6, wherein said fan is driven by the driving means.

8. The drum type drier according to claim 6, wherein said air inlet is formed on that side of the inlet-outlet port on which the clothings fall by the rotation of the drum.

* * * * *